US008991071B2

(12) United States Patent
Bathum et al.

(10) Patent No.: US 8,991,071 B2
(45) Date of Patent: Mar. 31, 2015

(54) SYSTEMS AND METHODS FOR SIDE SNAP FOOTBEDS

(75) Inventors: Dale Bathum, Boulder, CO (US); Damon Chen, Westminster, CO (US)

(73) Assignee: Crocs, Inc., Niwot, CO (US)

( * ) Notice: Subject to any disclaimer, the term of this patent is extended or adjusted under 35 U.S.C. 154(b) by 291 days.

(21) Appl. No.: 13/517,558

(22) Filed: Jun. 13, 2012

(65) Prior Publication Data

US 2013/0145651 A1 Jun. 13, 2013

Related U.S. Application Data

(60) Provisional application No. 61/496,457, filed on Jun. 13, 2011.

(51) Int. Cl.

| | |
|---|---|
| ***A43B 3/12*** | (2006.01) |
| ***A43B 13/38*** | (2006.01) |
| ***A43B 1/00*** | (2006.01) |
| ***A43B 3/10*** | (2006.01) |
| ***A43B 17/18*** | (2006.01) |

(52) U.S. Cl.

CPC ..... *A43B 13/38* (2013.01); *A43B 1/0027* (2013.01); *A43B 3/101* (2013.01); *A43B 17/18* (2013.01)

USPC ..... 36/11.5; 36/100; 36/101

(58) Field of Classification Search

USPC ..... 36/11.5, 100, 101, 43, 71

See application file for complete search history.

(56) References Cited

U.S. PATENT DOCUMENTS

| | | | | |
|---|---|---|---|---|
| 5,423,134 | A * | 6/1995 | Bagnaia et al. | 36/11.5 |
| 7,010,869 | B1 * | 3/2006 | Ellis, III | 36/25 R |
| 7,010,872 | B2 * | 3/2006 | Pawlus et al. | 36/100 |
| 7,444,763 | B2 * | 11/2008 | Grove et al. | 36/15 |
| 7,451,557 | B2 * | 11/2008 | McDonald et al. | 36/100 |
| 2005/0097781 | A1 * | 5/2005 | Greene | 36/101 |
| 2007/0289161 | A1 * | 12/2007 | Gerber | 36/11.5 |
| 2008/0168681 | A1 * | 7/2008 | Andersen et al. | 36/100 |
| 2009/0100713 | A1 * | 4/2009 | Adami et al. | 36/100 |
| 2009/0313850 | A1 * | 12/2009 | Affleck | 36/11.5 |

* cited by examiner

*Primary Examiner* — Marie Bays

(74) *Attorney, Agent, or Firm* — Faegre Baker Daniels LLP

(57) ABSTRACT

A snap-in footbed system according to embodiments of the present invention includes a shoe, wherein the shoe includes an inner surface and an outer surface, an aperture formed in a molded portion of the shoe from the inner surface to the outer surface, a footbed, wherein a top surface of the footbed is configured to receive a user's foot, wherein the footbed comprises a snap-in element, wherein the snap-in element comprises a head portion having at least one dimension that is sized to be larger than the aperture, such that when the head portion is passed through the aperture from the inner surface to the outer surface, one or both of the head portion and the aperture undergo elastic deformation, and such that when the head portion has been passed through the aperture, the snap-in element secures the footbed to the shoe.

18 Claims, 5 Drawing Sheets

SYSTEMS AND METHODS FOR SIDE SNAP FOOTBEDS

CROSS-REFERENCE TO RELATED APPLICATIONS

This application claims the benefit of U.S. Provisional Patent Application Ser. No. 61/496,457, filed on Jun. 13, 2011, which is incorporated by reference herein in its entirety for all purposes.

TECHNICAL FIELD

Embodiments of the present invention relate generally to molded footwear, and more specifically to footbed and shoe combinations.

BACKGROUND

In shoe construction, footbeds are typically adhered to shoes. In order to change the footbed, the original footbed must often be ripped out. In both traditional shoe construction and molded shoe construction, footbeds are typically permanently attached to soles during the shoe construction process. This does not permit footbeds to be interchanged, replaced, or customized based on color, shape, softness, material properties, or other factors.

SUMMARY

A snap-in footbed system according to embodiments of the present invention includes a shoe, wherein the shoe includes an inner surface and an outer surface, an aperture formed in a molded portion of the shoe between the inner surface and the outer surface, and a footbed, wherein a top surface of the footbed is configured to receive a user's foot. The footbed includes a snap-in element, which in turn includes a head portion having at least one dimension that is sized to be larger than the aperture, such that when the head portion is passed through the aperture from the inner surface to the outer surface, one or both of the head portion and the aperture undergo elastic deformation, and such that when the head portion has been passed through the aperture, the snap-in element secures the footbed to the shoe.

According to some embodiments of the present invention, the aperture is a first aperture, the snap-in element is a first snap-in element, the head portion is a first head portion, and the snap-in footbed system further includes a second aperture formed in the shoe from the inner surface to the outer surface. In such cases, the footbed may include a second snap-in element, wherein the second snap-in element includes a second head portion having at least one dimension that is sized to be larger than the second aperture, such that when the second head portion is passed through the second aperture from the inner surface to the outer surface, one or both of the second head portion and the second aperture undergo elastic deformation, and such that when the second head portion has been passed through the second aperture and the first head portion has been passed through the first aperture, the first and second snap-in elements secure the footbed to the shoe.

According to some embodiments of the present invention, the first aperture is on a medial side of the shoe, the second aperture is on a lateral side of the shoe, the first snap-in element is on a medial side of the footbed, and the second snap-in element is on a lateral side of the footbed. In some embodiments, the first and second snap-in elements are on a forefoot portion of the footbed, and the first and second apertures are on a forefoot portion of the shoe. According to some embodiments, the footbed further comprises a third snap-in element on the lateral side of the footbed and a fourth snap-in element on the medial side of the footbed, the shoe further includes a third aperture on the lateral side of the shoe and a fourth aperture on the medial side of the shoe, and the third and fourth snap-in elements are on a heel portion of the footbed while the third and fourth apertures are on a heel portion of the shoe. According to some embodiments of the present invention, the footbed further includes a fifth snap-in element on the lateral side of the footbed and a sixth snap-in element on the medial side of the footbed, and the shoe further includes a fifth aperture on the lateral side of the shoe and a sixth aperture on the medial side of the shoe. In such cases, the fifth and sixth snap-in elements may be located on the footbed between the first and second snap-in elements on one side and the third and fourth snap-in elements on another side, and the fifth and sixth apertures may be located on the shoe between the first and second apertures on one side and the third and fourth apertures on another side.

According to other embodiments of the present invention, the first and second snap-in elements are on a heel portion of the footbed, and the first and second apertures are on a heel portion of the shoe. According to such embodiments, the footbed further may further include a third snap-in element on the lateral side of the footbed and a fourth snap-in element on the medial side of the footbed, and the shoe may further include a third aperture on the lateral side of the shoe and a fourth aperture on the medial side of the shoe. In such cases, the third and fourth snap-in elements may be on a forefoot portion of the footbed and the third and fourth apertures may be on a forefoot portion of the shoe.

According to some embodiments of the present invention, the head portion and the aperture are sized such that when the head portion has been passed through the aperture, an inner side of the head portion contacts the outer surface of the molded portion and the footbed adjacent to the snap-in element contacts the inner surface of the molded portion. A neck portion may connect the head portion with the footbed, such that when the head portion has been passed through the aperture, the neck portion is at least partially surrounded by the aperture.

In some cases, the footbed and the snap-in element are formed of a single continuous molded piece of material. This single continuous molded piece of material may be a first single continuous molded piece of material, and the shoe may be formed of a second single continuous molded piece of material. The footbed may be a different color than the shoe. The footbed may be formed of a first material, and the shoe may be formed of a second material different from the first material, for example softer than the first material. In some cases, the footbed and the shoe are formed of the same material, which may be, for example, an ethylene-vinyl acetate copolymer.

According to some embodiments of the present invention, the footbed is a first footbed, and the system further includes a second footbed having a same shape as the first footbed, such that the first and second footbeds are interchangeable with respect to the shoe. According to some embodiments, the first footbed is a different color than the second footbed, or formed of a different (e.g. softer) material than the second footbed.

According to some embodiments of the present invention, the shoe is a first shoe, and the system further includes a second shoe having a same shape as the first shoe, such that the first and second shoes are interchangeable with respect to the footbed.

A snap-in footbed system according to other embodiments of the present invention includes a shoe, wherein the shoe is formed of unitary molded construction, and wherein the shoe includes an inner surface and an outer surface, an aperture formed in the shoe between the inner surface and the outer surface, and a footbed, wherein the footbed is formed of unitary molded construction, wherein a top surface of the footbed is configured to receive a user's foot, wherein the footbed comprises a snap-in element that is integrally formed with the footbed, wherein the snap-in element comprises a head portion having at least one dimension that is sized to be larger than the aperture, such that when the head portion is passed through the aperture from the inner surface to the outer surface, one or both of the head portion and the aperture undergo elastic deformation, and such that when the head portion has been passed through the aperture, the snap-in element secures the footbed to the shoe.

A method for attaching a footbed to a shoe according to embodiments of the present invention includes inserting a footbed into a shoe, wherein the shoe comprises an inner surface, an outer surface, and an aperture formed in a molded portion of the shoe between the inner surface and the outer surface, and wherein a top surface of the footbed is configured to receive a user's foot, wherein the footbed comprises a snap-in element, wherein the snap-in element comprises a head portion having at least one dimension that is sized to be larger than the aperture, and inserting the head portion of the snap-in element through the aperture from the inner surface to the outer surface by elastically deforming at least a portion of one or both of the snap-in element and the aperture, such that when the head portion has been passed through the aperture, the snap-in element secures the footbed to the shoe.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
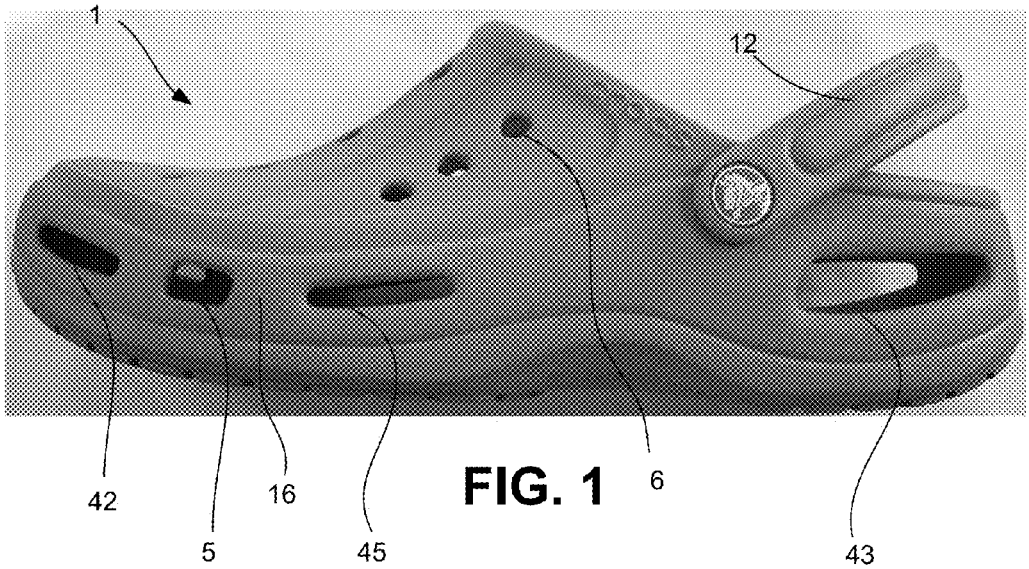
FIG. 1 illustrates an outer side elevation view of a shoe, according to embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 2:
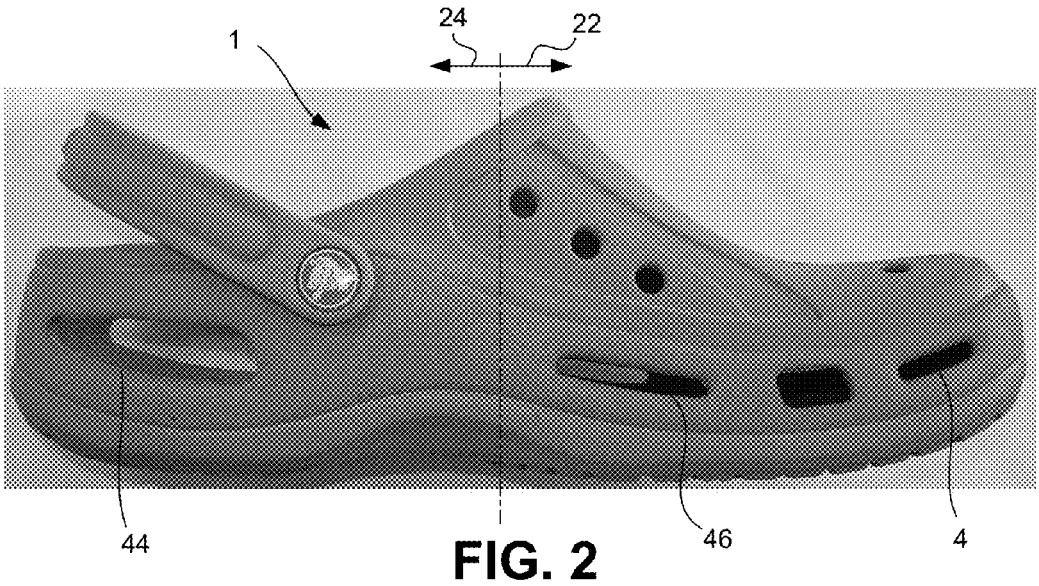
FIG. 2 illustrates an inner side elevation view of the shoe of FIG. 1, according to embodiments of the present invention.
Figure 3:
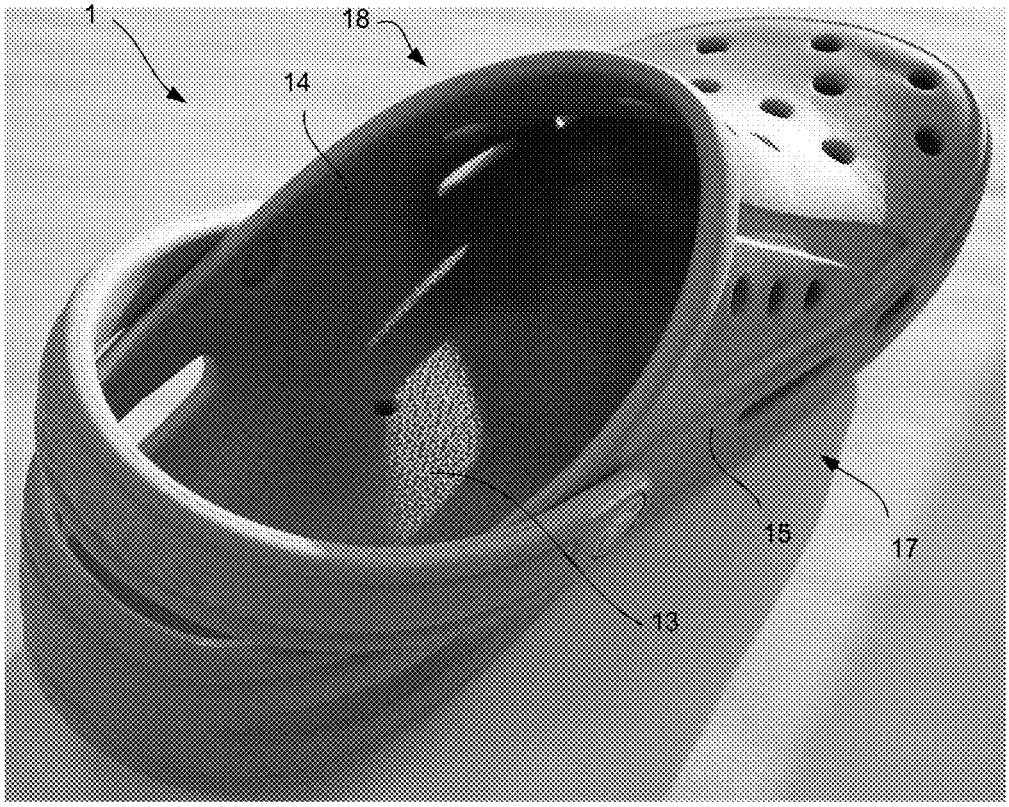
FIG. 3 illustrates a rear top perspective view of the shoe of FIGS. 1 and 2, according to embodiments of the present invention.
Figure 6:
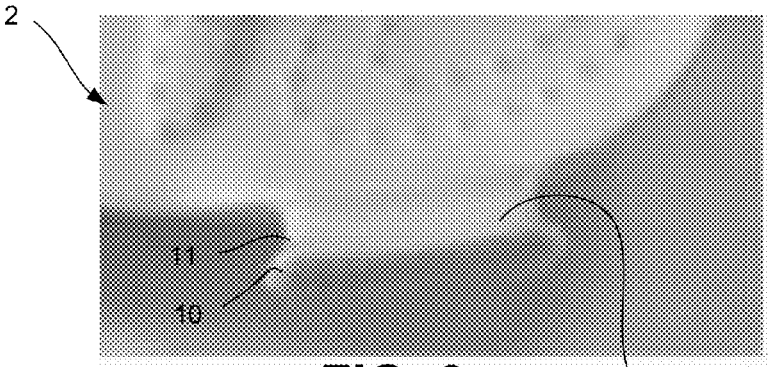
FIG. 6 illustrates an enlarged view of a side portion of the footbed of FIGS. 4 and 5, according to embodiments of the present invention.
Figure 4:
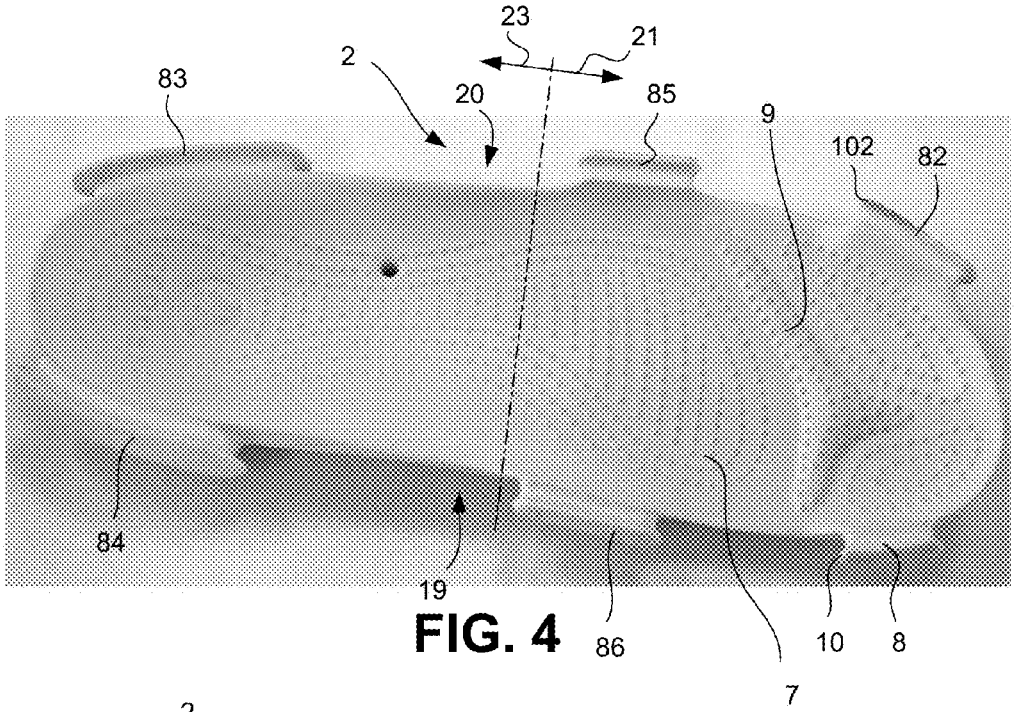
FIG. 4 illustrates a top plan view of a footbed, according to embodiments of the present invention.
Figure 5:
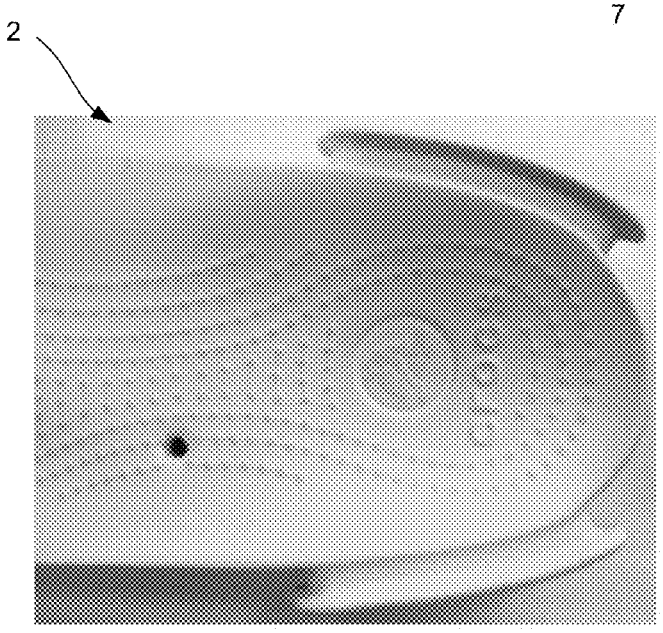
FIG. 5 illustrates an enlarged view of a heel portion of the footbed of FIG. 4, according to embodiments of the present invention.
Figure 7:
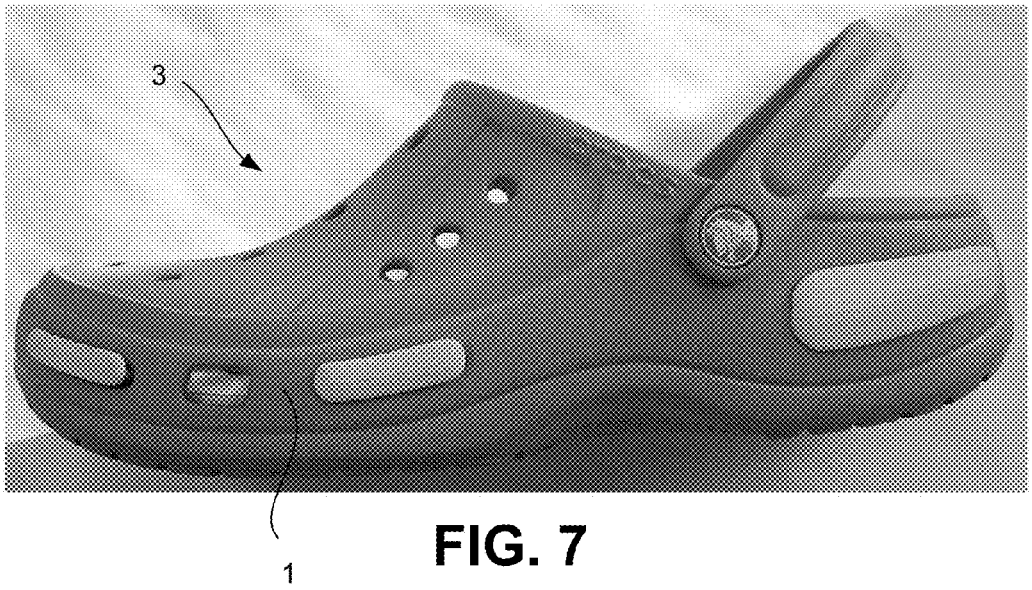
FIG. 7 illustrates an outer side elevation view of a shoe and footbed system combined, according to embodiments of the present invention.
Figure 8:
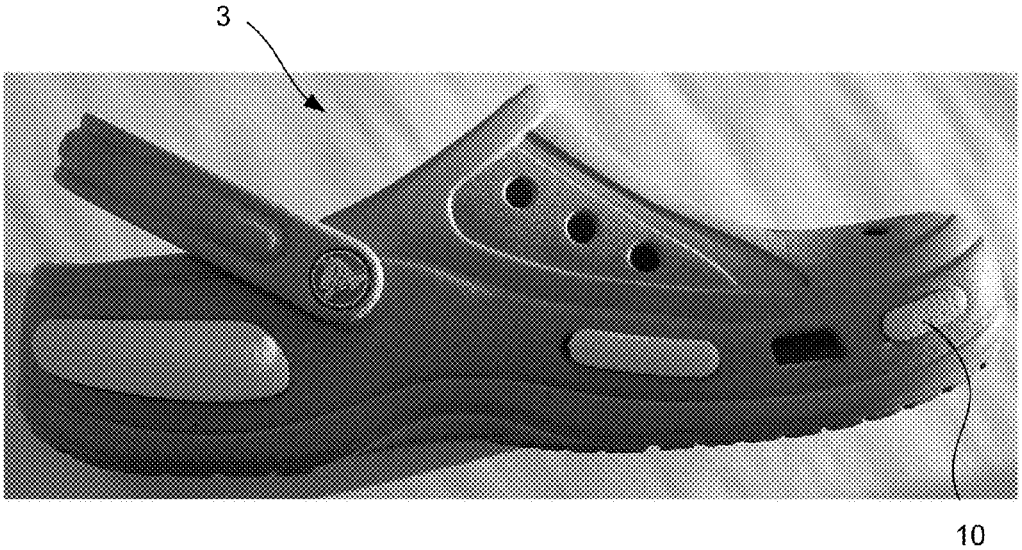
FIG. 8 illustrates an inner side elevation view of the shoe and footbed system of FIG. 7, according to embodiments of the present invention.
Figure 9:
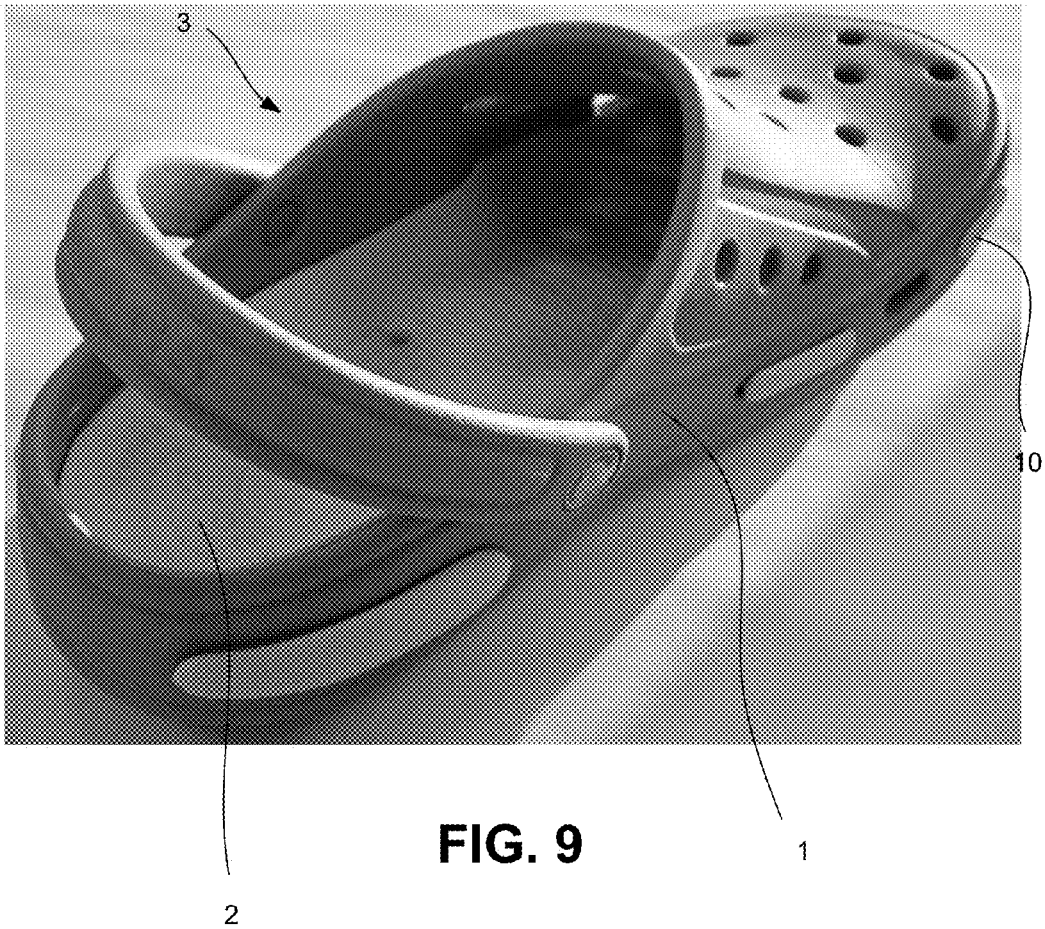
FIG. 9 illustrates a rear top perspective view of the shoe and footbed system of FIGS. 7 and 8, according to embodiments of the present invention.

FIG. 1 illustrates an outer side elevation view of a shoe 1, according to embodiments of the present invention. FIG. 2 illustrates an inner side elevation view of the shoe 1 of FIG. 1, according to embodiments of the present invention. FIG. 3 illustrates a rear top perspective view of the shoe 1 of FIGS. 1 and 2, according to embodiments of the present invention. FIG. 4 illustrates a top plan view of a footbed 2, according to embodiments of the present invention. FIG. 5 illustrates an enlarged view of a heel portion of the footbed 2 of FIG. 4, according to embodiments of the present invention. FIG. 6 illustrates an enlarged view of a side portion of the footbed 2 of FIGS. 4 and 5, according to embodiments of the present invention. FIG. 7 illustrates an outer side elevation view of a shoe and footbed system 3 combined, according to embodiments of the present invention. FIG. 8 illustrates an inner side elevation view of the shoe and footbed system 3 of FIG. 7, according to embodiments of the present invention. FIG. 9 illustrates a rear top perspective view of the shoe and footbed system 3 of FIGS. 7 and 8, according to embodiments of the present invention.

Shoe 1 may include an upper and a sole, and one or more side apertures formed on a substantially vertical portion of the upper. Side apertures 4 may be configured to receive snap-in portions 8 of a footbed 2, according to embodiments of the present invention. Side aperture 5 may be used for ventilation, before and/or after insertion of the footbed 2, according to embodiments of the present invention. Additional apertures 6 may be formed in a substantially horizontal portion of the upper, and may also be used for ventilation, according to embodiments of the present invention. Similar apertures may also be formed on the other side of the shoe 1, as illustrated in FIG. 2. The shoe 1 may be formed of a closed-cell resin molded foam, for example Croslite® made by Crocs, Inc. of Niwot, Colo. The shoe 1 may be formed as one single unitary molded piece, according to embodiments of the present invention. Shoe 1 may include a strap 12, according to embodiments of the present invention.

Footbed 2 may include one or more snap-in elements 8 and an elevated toe bar 9 on a top surface 7, according to embodiments of the present invention. The footbed 2 may be formed of a closed-cell resin molded foam, for example Croslite® made by Crocs, Inc. of Niwot, Colo. The footbed 2 may be formed of the same material as, or a different material from, shoe 1, according to embodiments of the present invention. The snap-in elements may be formed integrally with the footbed 2, and may extend from a side of the footbed 2. As illustrated in FIGS. 5 and 6, each snap-in element includes a neck portion 11 and a head portion 10. The width of the neck portion 11 may be substantially the same as or greater than a thickness of the shoe 1 at the location of the aperture 4, so that when inserted through the aperture, the head portion 10 has passed through the aperture. The head portion 10 may have a width and/or height and/or overall dimension that is larger in its at-rest or unexpanded state than a width and/or height and/or overall dimension of the aperture 4 in its at-rest or unexpanded state.

The footbed 2 may be inserted into the shoe 1 as illustrated in FIGS. 7-9 to form system 3, according to embodiments of the present invention. Once the footbed 2 is inserted into the shoe, one or more or each of the head portions 10 may be inserted through, and/or snapped or pushed through, the corresponding apertures 4 in the shoe 1 in order to secure the footbed 2 in place within the shoe 1, according to embodiments of the present invention. According to embodiments of the present invention, multiple head portions 10 are located on each of the medial and lateral sides of the footbed 2, for example two or three on each such side, and the shoe 1 has corresponding apertures 4 to accept the head portions 10. According to embodiments of the present invention, the footbed 2 has at least one, and/or at least one pair, of snap-in elements 8 on the forefoot area or forward area of the footbed 2, and at least one, and/or at least one pair, of snap-in elements 8 on the heel portion of the footbed 2, and the shoe 1 has corresponding apertures 4 to accept the head portions 10. According to embodiments of the present invention, both the footbed 2 and the shoe 1 are deformable ethylene vinyl acetate ("EVA") copolymer based foam molded products and the snap-in elements 8 and/or apertures 4 undergo deformation (e.g. elastic deformation) as the head portions 10 are inserted through the apertures 4. According to embodiments of the present invention, the head portions 10 resume the same at-rest, undeformed shape after passing through apertures 4 as they possessed before passing through apertures 4.

Systems such as system 3 permit various color combinations of shoes 1 and footbed inserts 2 to be mixed and/or matched and/or customized. Also, different materials, and/or different types of materials, may be used and/or customized for the shoe 1 and the footbed 2. This creates a very versatile and customizable footwear system, while maintaining a high level of comfort for the finished system. According to some embodiments of the present invention, the top surface 13 of the inside of the shoe 1 (see FIG. 3) includes a texture, for example a rough texture (e.g. molded bumps or protrusions or indentations). This texturing may be molded into the shoe, or applied to the shoe. According to other embodiments, a similar texture, for example a rough texture, is applied to or molded into a bottom surface (not shown) of the footbed insert 2. According to yet other embodiments, both the top surface 13 of the inside of the shoe 1 and the bottom surface of the footbed insert 2 include such a texture. This texture on either surface is an optional feature which deters smaller-scale sliding of the footbed insert 2 with respect to the shoe 1.

According to embodiments of the present invention, no glue or adhesive or other joining material or mechanism is used to securely hold the footbed 2 to the shoe 1, other than the simple "snap-in" interface described. Recyclable and/or biodegradable materials may also be used, to further lessen environmental impact of the shoe construction.

The configuration of system 1 permits the creation and supply of various types and/or colors of footbeds 2 to consumers. One customer could purchase a soft, medium, or more firm footbed 2 with various arch heights for more consumer customization, and the consumer, retailer, and/or medical professional could interchange insoles (e.g. footbeds 2) with the same base shoe 1 to meet the customer's needs in the shop, at the location of sale. Also, as the snap in process is in the sides of the clog/shoe 1, there is no wear and tear on the snap-through components 8. The product will therefore last longer and work effectively for a long period of time.

A snap-in footbed system according to some embodiments of the present invention includes a shoe 1, wherein the shoe 1 includes an inner surface 14 and an outer surface 15, an aperture 4 formed in a molded portion 16 of the shoe 1 between the inner surface 14 and the outer surface 15, and a footbed 2, wherein a top surface 7 of the footbed 2 is configured to receive a user's foot. The footbed 2 includes a snap-in element 8, which in turn includes a head portion 10 having at least one dimension that is sized to be larger than the aperture 4, such that when the head portion 10 is passed through the aperture 4 from the inner surface 14 to the outer surface 15, one or both of the head portion 10 and the aperture 4 undergo elastic deformation, and such that when the head portion 10 has been passed through the aperture 4, the snap-in element 8 secures the footbed 2 to the shoe 1 (for example, as illustrated in FIGS. 7-9).

According to some embodiments of the present invention, the aperture 4 is a first aperture 4, the snap-in element is a first snap-in element 8, the head portion 10 is a first head portion 10, and the snap-in footbed system further includes a second aperture 42 formed in the shoe 1 from the inner surface 14 to the outer surface 15. In such cases, the footbed 2 may include a second snap-in element 82, wherein the second snap-in element 82 includes a second head portion 102 having at least one dimension that is sized to be larger than the second aperture 42, such that when the second head portion 102 is passed through the second aperture 42 from the inner surface 14 to the outer surface 15, one or both of the second head portion 102 and the second aperture 42 undergo elastic deformation, and such that when the second head portion 102 has been passed through the second aperture 42 and the first head portion 10 has been passed through the first aperture 4, the first and second snap-in elements 8, 82 secure the footbed 2 to the shoe 1.

According to some embodiments of the present invention, the first aperture 4 is on a medial side 17 of the shoe, the second aperture 42 is on a lateral side 18 of the shoe, the first snap-in element 8 is on a medial side 19 of the footbed 2, and the second snap-in element 82 is on a lateral side 20 of the footbed 2. In some embodiments, the first and second snap-in elements 8, 82 are on a forefoot portion 21 of the footbed, and the first and second apertures 4, 42 are on a forefoot portion 22 of the shoe. According to some embodiments, the footbed 2 further comprises a third snap-in element 83 on the lateral side 20 of the footbed 2 and a fourth snap-in element 84 on the medial side 19 of the footbed 2, the shoe 1 further includes a third aperture 43 on the lateral side 18 of the shoe 1 and a fourth aperture 44 on the medial side 17 of the shoe 1, and the third and fourth snap-in elements 83, 83 are on a heel portion 23 of the footbed 2 while the third and fourth apertures 43, 44 are on a heel portion 24 of the shoe 1. According to some embodiments of the present invention, the footbed 2 further includes a fifth snap-in element 85 on the lateral side 20 of the footbed 2 and a sixth snap-in element 86 on the medial side 19 of the footbed 2, and the shoe 1 further includes a fifth aperture 45 on the lateral side 18 of the shoe 1 and a sixth aperture 46 on the medial side 17 of the shoe 1. In such cases, the fifth and sixth snap-in elements 85, 86 may be located on the footbed 2 between the first and second snap-in elements 8, 82 on one side and the third and fourth snap-in elements 83, 84 on another side, and the fifth and sixth apertures 45, 46 may be located on the shoe 1 between the first and second apertures 4, 42 on one side and the third and fourth apertures 43, 44 on another side.

According to some embodiments of the present invention, the head portion 10 and the aperture 4 are sized such that when the head portion 10 has been passed through the aperture 4, an inner side 25 of the head portion 10 contacts the outer surface 15 of the molded portion 16 and the footbed 2 adjacent to the snap-in element 8 contacts the inner surface 14 of the molded portion 16. A neck portion 11 may connect the head portion 10 with the footbed 2, such that when the head portion 10 has been passed through the aperture 4, the neck portion 11 is at least partially surrounded by the aperture 4.

In some cases, the footbed 2 and the snap-in element 8 are formed of a single continuous molded piece of material. This single continuous molded piece of material may be a first single continuous molded piece of material, and the shoe 1 may be formed of a second single continuous molded piece of material. The footbed 2 may be a different color than the shoe 1. The footbed 2 may be formed of a first material, and the shoe 1 may be formed of a second material different from the first material, for example softer than the first material. In some cases, the footbed 2 and the shoe 1 are formed of the same material, which may be, for example, an ethylene-vinyl acetate copolymer.

According to some embodiments of the present invention, the footbed 2 is a first footbed, and the system further includes a second footbed having a same shape as the first footbed 2, such that the first and second footbeds are interchangeable with respect to the shoe 1. According to some embodiments, the first footbed 2 is a different color than the second footbed, or formed of a different (e.g. softer) material than the second footbed.

According to some embodiments of the present invention, the shoe 1 is a first shoe, and the system further includes a second shoe having a same shape as the first shoe 1, such that the first and second shoes are interchangeable with respect to the footbed 2.

A method for attaching a footbed to a shoe according to embodiments of the present invention includes inserting a footbed 2 into a shoe 1, wherein the shoe comprises an inner surface 14, an outer surface 15, and an aperture 4 formed in a molded portion 16 of the shoe 1 from the inner surface 14 to the outer surface 15, and wherein a top surface 7 of the footbed 2 is configured to receive a user's foot, wherein the footbed 2 includes a snap-in element 8, wherein the snap-in element 8 includes a head portion 10 having at least one dimension that is sized to be larger than the aperture 4, and inserting the head portion 10 of the snap-in element 8 through the aperture 4 from the inner surface 14 to the outer surface 15 by elastically deforming at least a portion of one or both of the snap-in element 8 and the aperture 4, such that when the head portion 10 has been passed through the aperture 4, the snap-in element 8 secures the footbed 2 to the shoe 1. According to some embodiments of the present invention, when all of the snap-in elements are fitted within their respective apertures, the footbed 2 is secured (e.g. snugly secured) on the shoe 1 and rests on the shoe 1. The head portions, neck portions, deformability, and dimensioning of snap-in elements 82, 83, 84, 85, 86 may function similarly to head portion 10 and neck portion 11 of snap-in element 8 and may interact with their respective apertures 42, 43, 44, 45, 46 similarly to how snap-in element 8 interacts with aperture 4, according to embodiments of the present invention.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, feature combinations, and variations as fall within the scope of the claims, together with all equivalents thereof.

What is claimed is:

1. A snap-in footbed system comprising:

a shoe, wherein the shoe comprises an inner surface and an outer surface;

a first aperture formed in a molded portion of the shoe between the inner surface and the outer surface;

a footbed, wherein a top surface of the footbed is configured to receive a user's foot, wherein the footbed comprises a first snap-in element, wherein the first snap-in element comprises a first head portion having at least one dimension that is sized to be larger than the first aperture, such that when the first head portion is passed through the first aperture from the inner surface to the outer surface, one or both of the first head portion and the first aperture undergo elastic deformation, and such that when the first head portion has been passed through the first aperture, the first snap-in element secures the footbed to the shoe;

a second aperture formed in the shoe from the inner surface to the outer surface, and wherein the footbed comprises a second snap-in element, wherein the second snap-in element comprises a second head portion having at least one dimension that is sized to be larger than the second aperture, such that when the second head portion is passed through the second aperture from the inner surface to the outer surface, one or both of the second head portion and the second aperture undergo elastic deformation, and such that when the second head portion has been passed through the second aperture and the first head portion has been passed through the first aperture, the first and second snap-in elements secure the footbed to the shoe, wherein the first aperture is on a medial side of the shoe, wherein the second aperture is on a lateral side of the shoe, wherein the first snap-in element is on a medial side of the footbed, and wherein the second snap-in element is on a lateral side of the footbed, and wherein the first and second snap-in elements are on a forefoot portion of the footbed, and the first and second apertures are on a forefoot portion of the shoe.

2. The snap-in footbed system of claim 1, wherein the footbed further comprises a third snap-in element on the lateral side of the footbed and a fourth snap-in element on the medial side of the footbed, wherein the shoe further comprises a third aperture on the lateral side of the shoe and a fourth aperture on the medial side of the shoe, and wherein the third and fourth snap-in elements are on a heel portion of the footbed and the third and fourth apertures are on a heel portion of the shoe.

3. The snap-in footbed system of claim 2, wherein the footbed further comprises a fifth snap-in element on the lateral side of the footbed and a sixth snap-in element on the medial side of the footbed, wherein the shoe further comprises a fifth aperture on the lateral side of the shoe and a sixth aperture on the medial side of the shoe, and wherein the fifth and sixth snap-in elements are located on the footbed between the first and second snap-in elements on one side and the third and fourth snap-in elements on another side, and wherein the fifth and sixth apertures are located on the shoe between the first and second apertures on one side and the third and fourth apertures on another side.

4. The snap-in footbed system of claim 1, wherein the first head portion and the first aperture are sized such that when the first head portion has been passed through the first aperture, an inner side of the first head portion contacts the outer surface of the molded portion and the footbed adjacent to the first snap-in element contacts the inner surface of the molded portion.

5. The snap-in footbed system of claim 4, further comprising a neck portion connecting the first head portion with the footbed, wherein when the first head portion has been passed through the first aperture, the neck portion is at least partially surrounded by the first aperture.

6. The snap-in footbed system of claim 1, wherein the footbed and the first snap-in element are formed of a single continuous molded piece of material.

7. The snap-in footbed system of claim 6, wherein the single continuous molded piece of material is a first single continuous molded piece of material, and wherein the shoe is formed of a second single continuous molded piece of material.

8. The snap-in footbed system of claim 1, wherein the footbed is a different color than the shoe.

9. The snap-in footbed system of claim 1, wherein the footbed is formed of a first material, and wherein the shoe is formed of a second material different from the first material.

10. The snap-in footbed system of claim 9, wherein the first material is softer than the second material.

11. The snap-in footbed system of claim 1, wherein the footbed and the shoe are formed of a same material.

12. The snap-in footbed system of claim 11, wherein the same material comprises an ethylene-vinyl acetate copolymer.

13. The snap-in footbed system of claim 1, wherein the footbed is a first footbed, the system further comprising a second footbed having a same shape as the first footbed, wherein the first and second footbeds are interchangeable with respect to the shoe.

14. The snap-in footbed system of claim 13, wherein the first footbed is a different color than the second footbed.

15. The snap-in footbed system of claim 13, wherein the first footbed is formed of a first material, and wherein the second footbed is formed of a second material different from the first material.

16. The snap-in footbed system of claim 15, wherein the first material is softer than the second material.

17. The snap-in footbed system of claim 1, wherein the shoe is a first shoe, the system further comprising a second shoe having a same shape as the first shoe, wherein the first and second shoes are interchangeable with respect to the footbed.

18. A snap-in footbed system comprising:

a shoe, wherein the shoe comprises an inner surface and an outer surface;

a first aperture formed in a molded portion of the shoe between the inner surface and the outer surface;

a footbed, wherein a top surface of the footbed is configured to receive a user's foot, wherein the footbed comprises a first snap-in element, wherein the first snap-in element comprises a first head portion having at least one dimension that is sized to be larger than the first aperture, such that when the first head portion is passed through the first aperture from the inner surface to the outer surface, one or both of the first head portion and the first aperture undergo elastic deformation, and such that when the first head portion has been passed through the first aperture, the first snap-in element secures the footbed to the shoe;

a second aperture formed in the shoe from the inner surface to the outer surface; and wherein the footbed comprises a second snap-in element, wherein the second snap-in element comprises a second head portion having at least one dimension that is sized to be larger than the second aperture, such that when the second head portion is passed through the second aperture from the inner surface to the outer surface, one or both of the second head portion and the second aperture undergo elastic deformation, and such that when the second head portion has been passed through the second aperture and the first head portion has been passed through the first aperture, the first and second snap-in elements secure the footbed to the shoe, wherein the first aperture is on a medial side of the shoe, wherein the second aperture is on a lateral side of the shoe, wherein the first snap-in element is on a medial side of the footbed, and wherein the second snap-in element is on a lateral side of the footbed, and wherein the first and second snap-in elements are on a heel portion of the footbed, and the first and second apertures are on a heel portion of the shoe, wherein the footbed further comprises a third snap-in element on the lateral side of the footbed and a fourth snap-in element on the medial side of the footbed, wherein the shoe further comprises a third aperture on the lateral side of the shoe and a fourth aperture on the medial side of the shoe, and wherein the third and fourth snap-in elements are on a forefoot portion of the footbed and the third and fourth apertures are on a forefoot portion of the shoe.

* * * * *